US006643852B1

(12) United States Patent
Lin

(10) Patent No.: US 6,643,852 B1
(45) Date of Patent: Nov. 11, 2003

(54) AUTOMATED INDUCTION TOILET BOWL SEAT LIFT SYSTEM

(76) Inventor: Yen-Chun Lin, 2F, No. 19, Lane 127, Ho Chiang St., Chung Shan District, Taipei (TW)

( * ) Notice: Subject to any disclaimer, the term of this patent is extended or adjusted under 35 U.S.C. 154(b) by 3 days.

(21) Appl. No.: 10/225,202

(22) Filed: Aug. 22, 2002

(51) Int. Cl.[7] ..... A47K 13/10
(52) U.S. Cl. ..... 4/246.1
(58) Field of Search ..... 4/246.1–246.5

(56) References Cited

U.S. PATENT DOCUMENTS 4,995,120 A * 2/1991 Tager ..... 4/246.1
5,307,524 A * 5/1994 Veal ..... 4/246.1
5,603,127 A * 2/1997 Veal ..... 4/246.1

* cited by examiner

*Primary Examiner*—Tuan N. Nguyen
(74) *Attorney, Agent, or Firm*—Bacon & Thomas, PLLC

(57) ABSTRACT

An automated induction toilet bowl seat lift system comprised of a drive mechanism, two detectors respectively provided in the front and in the rear at the bottom of a seat, and a circuit board module characterized by that both detectors detect approaching or leaving human body, e.g. one hand, to command the seat to lift up or to drop flat through the circuit board module.

7 Claims, 5 Drawing Sheets

AUTOMATED INDUCTION TOILET BOWL SEAT LIFT SYSTEM

BACKGROUND OF THE INVENTION (a) Field of the Invention

The present invention is related to an auto induction toilet bowl seat lift system, and more particularly, to one that a detector is respectively mounted to a pre-selected location in the front and in the rear of the bottom of the seat cover to automatically detect approaching or leaving user and to lift or drop the seat in time by adapting to a circuit board module and a drive mechanism.

(b) Description of the Prior Art

For most of the toilet bowls generally available in the market, the seat is pivoted to the bowl. The seat is dropped or lifted by manual to help maintain the surface of the bowl clean. However, not necessarily everyone would bother to lift the seat after the use. Therefore, a design of automated lift mechanism is provided. Nerveless, the user has to contact the seat by hand since the automated lift mechanism works essentially by taking advantage of a damper system, and it takes the user to manually press down the seat. It is not yet considered as well covered in terms of personal hygiene maintenance.

SUMMARY OF THE INVENTION

The primary purpose of the present invention is to provide an automated induction toilet bowl seat lift system that allows easy and fast use of the toilet bowl without having to contact the seat, essentially comprised of a drive mechanism, two detectors each respectively mounted at a selected location in front of and in rear of the bottom of the seat, and a circuit board module. Both detectors respectively detect the approaching or leaving human body (e.g., the hand) to command the drive mechanism through the circuit board module to either drop or lift the seat to help maintain personal hygiene.

Another purpose of the present invention is to provide an automated induction toilet bowl seat lift system, wherein, the drive mechanism includes a motor, a transmission gear is disposed at the output of the motor to engage a passive gear provided on one side of the seat to drive the seat to be dropped flush or lifted vertically within the range of a given angle.

Another purpose yet of the present invention is to provide an automated induction toilet bowl seat lift system, wherein, a unit of battery is connected to the drive mechanism as a stand-by power source in case of failure of external source.

Another purpose yet of the present invention is to provide an automated induction toilet bowl seat lift system, wherein, an ozone de-odorizing device is provided at a pre-selected location with its on and off controlled by the circuit board module to achieve de-odorizing and sterilization effects and to further maintain the toilet in clean and free of smells.

DETAILED DESCRIPTION OF THE PREFERRED EMBODIMENTS

Figure 1:
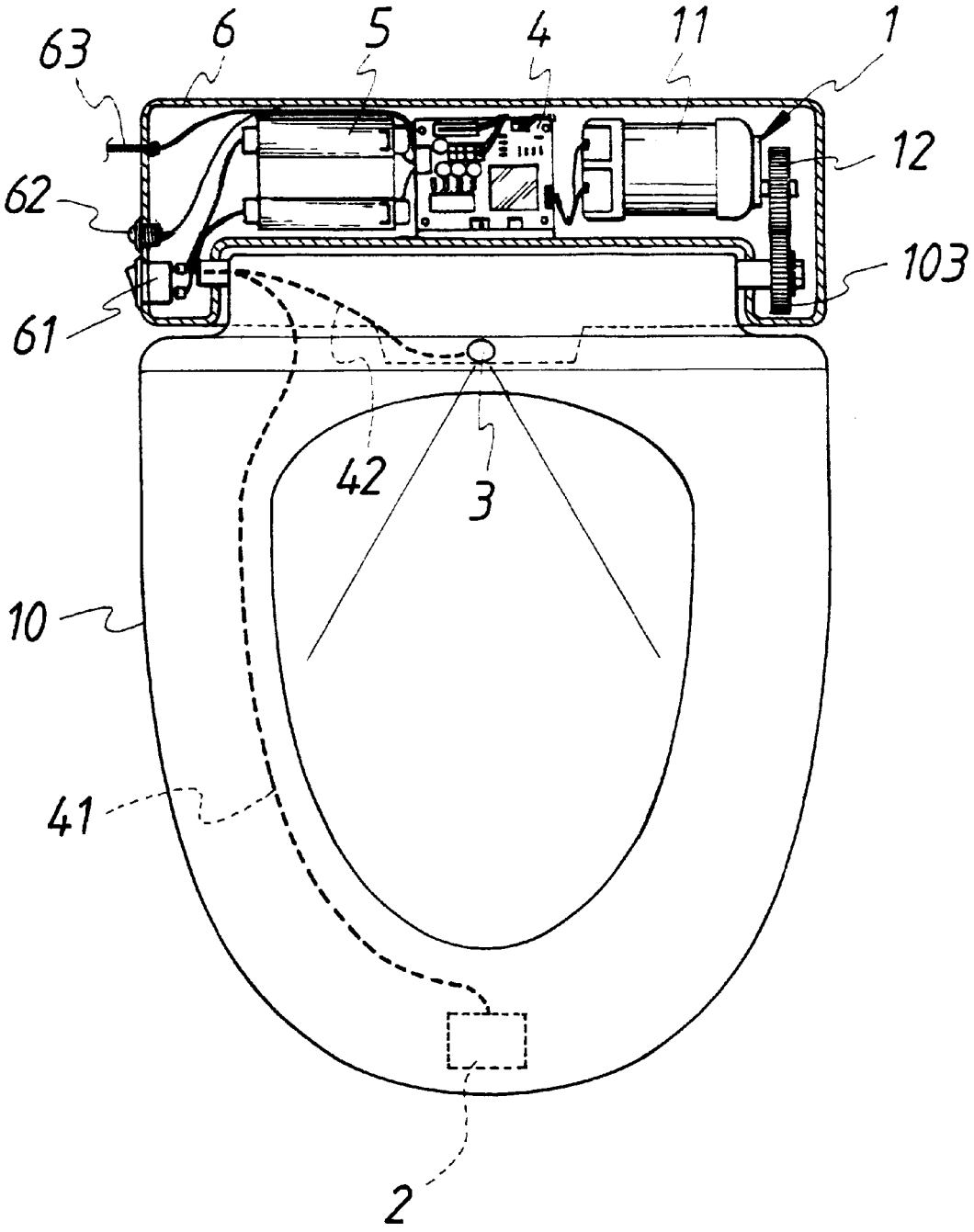
FIG. 1 is a schematic view of an assembly of a preferred embodiment of the present invention.
Figure 2:
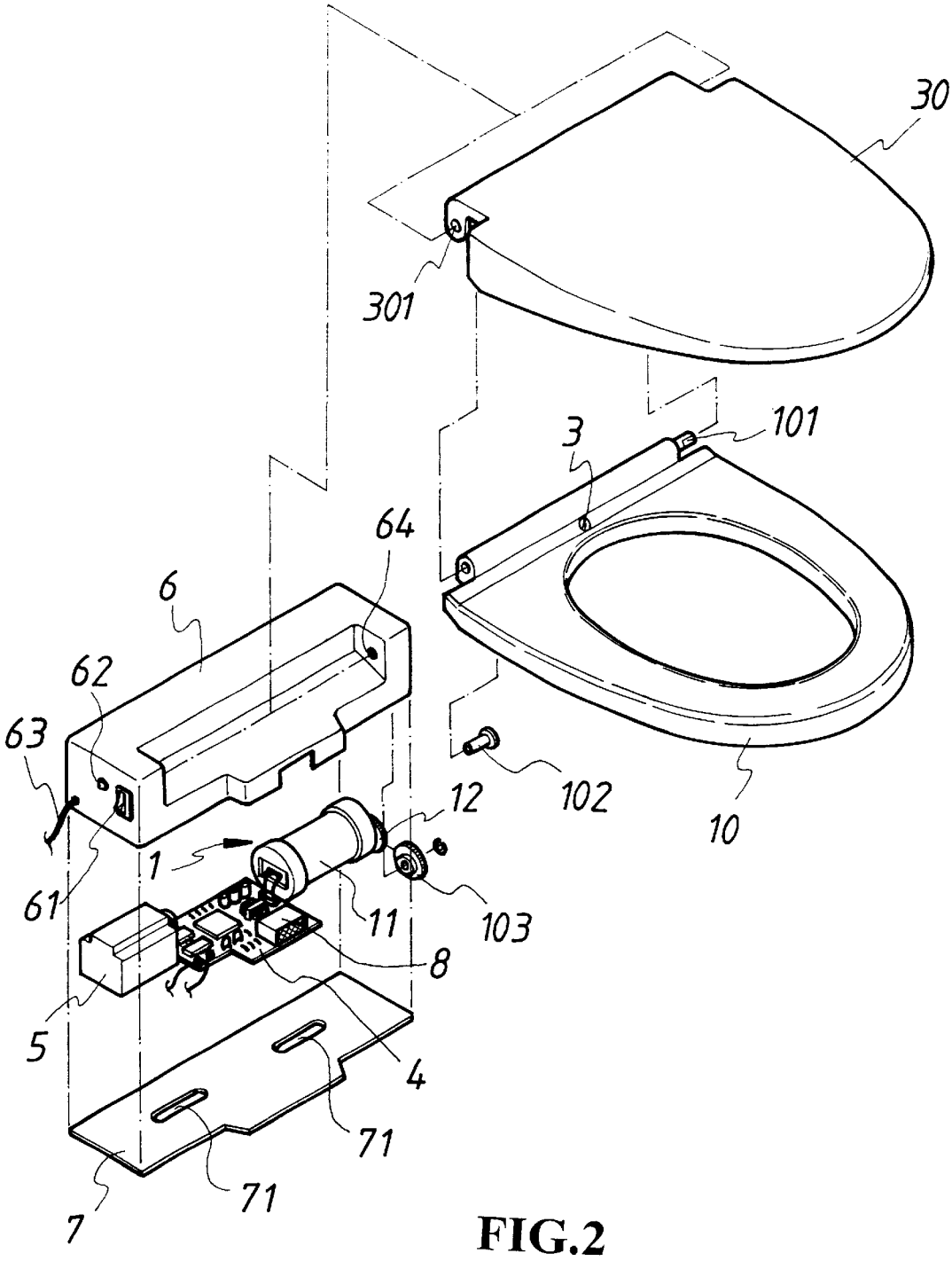
FIG. 2 is a perspective view of the preferred embodiment of the present invention.

Referring to FIGS. 1 and 2, a preferred embodiment of the present invention is essentially comprised of a drive mechanism 1, two detectors 2, 3 and a circuit board module 4. Wherein, the drive mechanism 1 includes a motor 11 and a transmission gear 12 disposed at the output of the motor 11.

Figure 3:
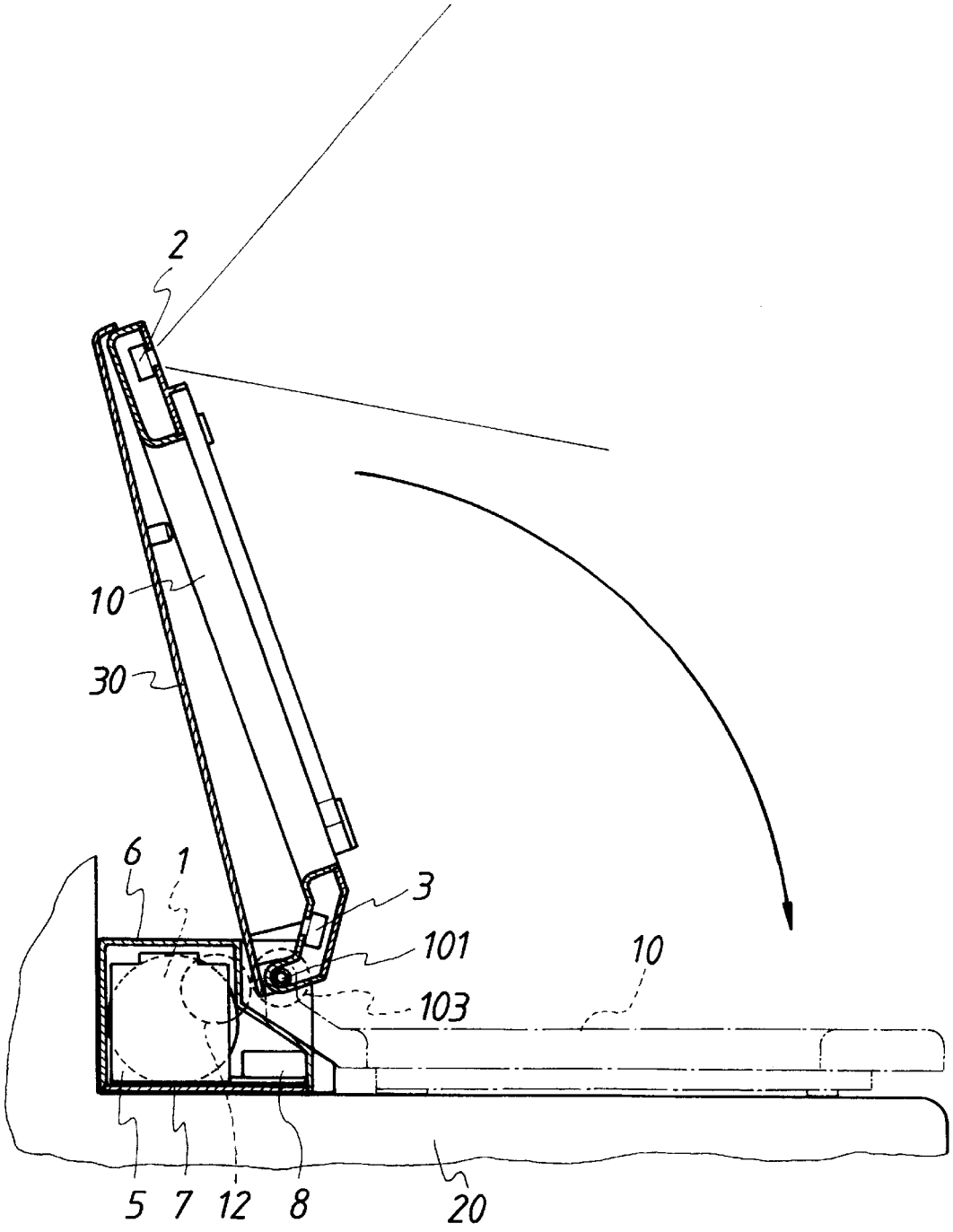
FIG. 3 is a schematic view showing that a seat of a toilet bowl of the preferred embodiment is lifted.
Figure 4:
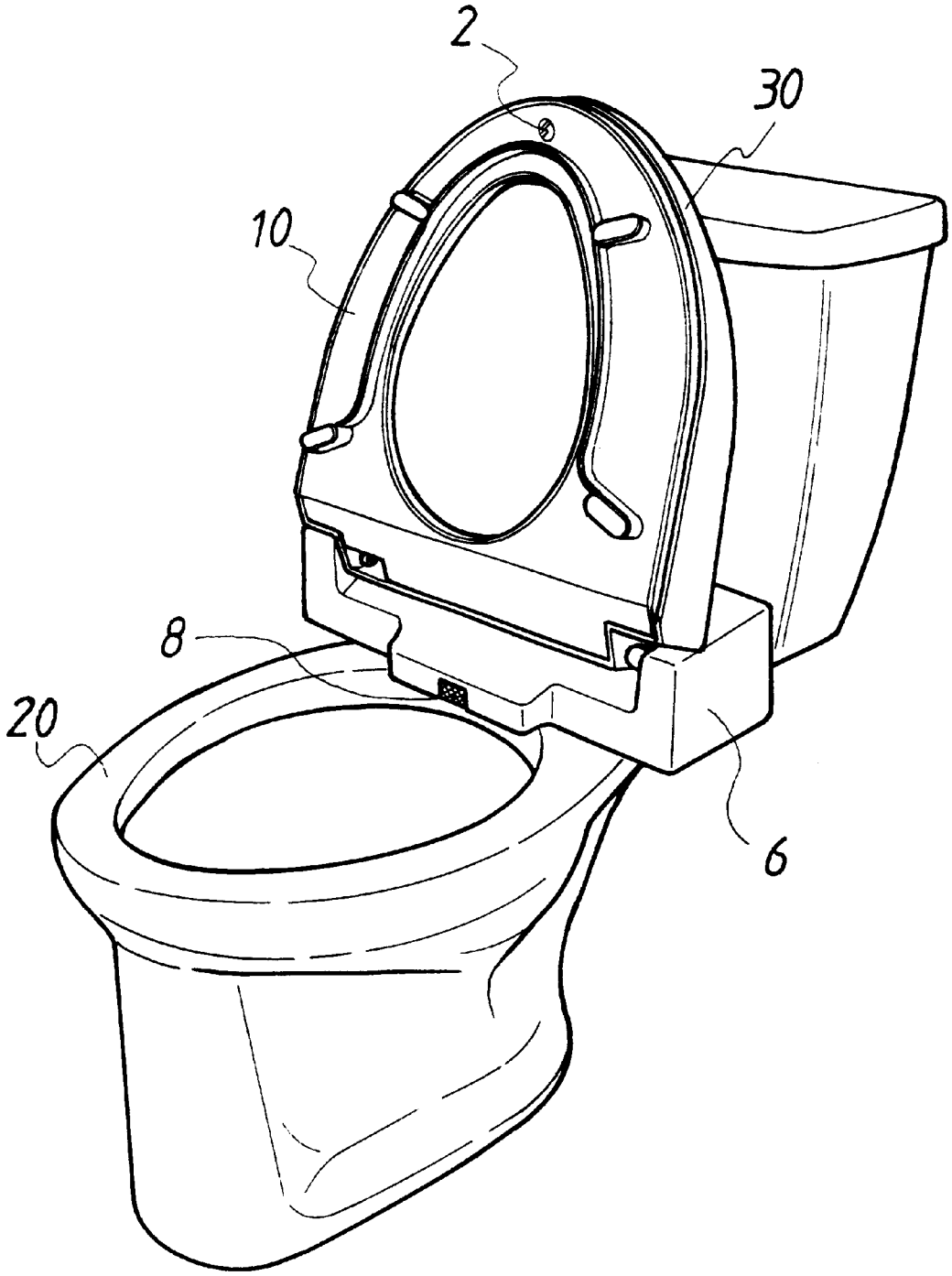
FIG. 4 is a perspective view of the preferred embodiment of the present invention with the seat being lifted up.
Figure 5:
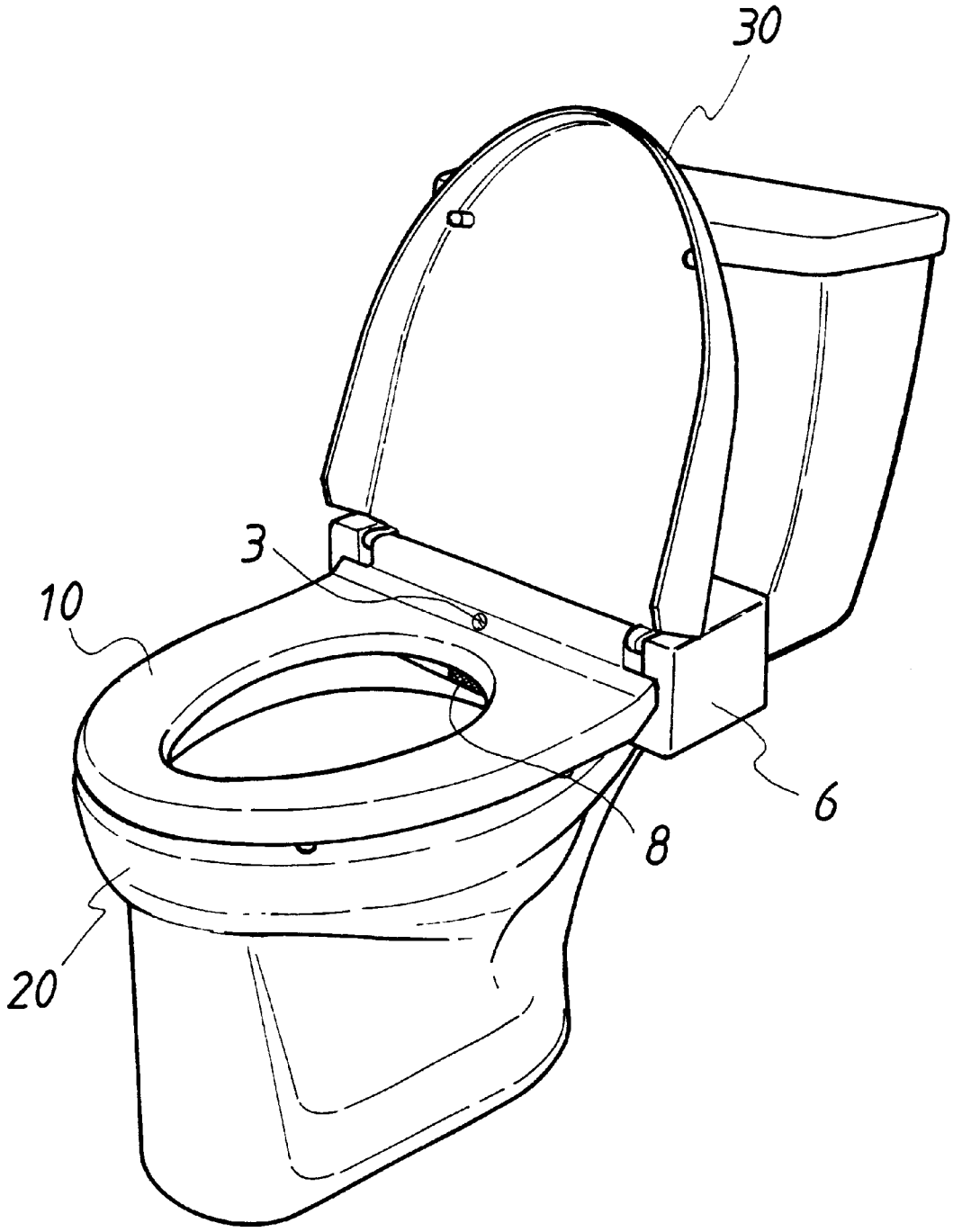
FIG. 5 is a perspective view of the preferred embodiment of the present invention with the seat being dropped flat.

Two detectors 2, 3 are respectively mounted at pre-selected locations in front of and in rear of the bottom of a toilet bowl seat 10; the detector 2 being mounted at the front detects an approaching human body (e.g. one's hand) when the seat 10 is lifted up when the toilet bowl is not used as illustrated in FIGS. 3 and 4, then sends signals to have the seat 10 to be dropped flat as driven by the drive mechanism 1 as illustrated in FIG. 5. On the other hand, the detector 3 mounted in the rear detects the leaving human body (i.e. the hips) when the seat 10 is dropped flat for use, then sends signals to have the seat to be lifted up as driven by the drive mechanism 1.

The circuit board module 4 related to a circuit control unit is adapted with two conductors 41, 42 buried at the bottom of the seat 10 to respectively connect to those two detectors 2, 3 provided at pre-selected locations in the front and in the rear of the bottom of the seat 10.

When assembled, those two detectors 2, 3 respectively detect the approaching or leaving human body (e.g., one's hand), and the drive mechanism 1 drives the seat 10 through the circuit board module 4 to either drop flat or lift up without contacting the seat.

The drive mechanism 1 may be further connected to a set of battery as emergency source.

Both of the drive mechanism 1 and the circuit board module 4 may be provided in a housing 6, wherein a switch 61, a power indicator 62 and a power cable 63 are provided on the selected side, and one hole 64 is each provided on both sides of the housing 6 to be pivoted to two shafts 101, 102 on both sides of the seat 10. The shaft 101 related to a fixed type has at its one end mounted with a passive gear 103 to engage a gear 12 from the drive mechanism 1. When the motor 11 drives, the seat 10 is synchronously driven to either drop flat or lift up depending on the status as detected. Both of the shafts 101, 102 penetrate through a pivoting hole 301 respectively provided on both sides of a seat cover 30.

As illustrated in FIG. 2, the housing 6 is secured to a strip type of locking board 7 and a slot 71 is provided in the locking board 7 to receive insertion of a fastener to lock up the housing 6 to a toilet bowl 20.

Now referring to FIGS. 1 and 2, the mobile shaft 102 on the other side of the seat 10 relates to a hollow tube to be pivoted to the housing 6 though the hole 64 and to permit passing through of two conductors 41, 42 of the circuit board module 4 so that both of the conductors 41, 42 are concealed at the bottom of the seat 10 while being respectively connected to the detectors 2, 3.

Furthermore, a delay circuit is provided to the circuit board module 4 for the seat 10 to have a delayed lift once the user leaves the bowl 30 without contacting or hitting the seat 10. Similarly, a detection circuit is separately provided to the circuit board module. When the circuit board module 4 picks up the signals of approaching human body from the detector 2, the seat 10 is driven to drop flat however, the detection circuit will send signals to have the seat 10 to lift up again if within a given time the detector 3 at the rear fails to detect that the user is seated on the bowl 30.

Two switches respectively to force dropping and lifting of the seat 10 may be further adapted to the control of the drive mechanism 1 so that in case of a cleaning routing of the bowl 30 is required, the switch is depressed to force the seat 10 to lift up or drop flat.

An ozone de-odorizing device 8 may be mounted at a selected location in the housing 6 to be automatically turned on or off through the control by the circuit board module 4 to complete de-odorizing and sterilization thus making the toilet bowl cleaner and free of smells.

What is claimed is:

1. An automated induction toilet bowl seat lift system comprised of a drive mechanism, two detectors and a circuit board module, wherein, the drive mechanism including a motor, and a transmission gear mounted at the output of the motor;

two detectors being respectively provided at pre-selected locations in the front and in the rear of the seat; and the circuit board module, related to a circuit control unit, adapted with two conductors buried at the bottom of the seat, and respectively connected to the front and the rear detectors at the bottom of the seat; characterized by that:

both detectors detecting approaching or leaving human body while commanding the seat to either lift or drop flat by the drive mechanism through the circuit board module.

2. An automated induction toilet bowl seat lift system as claimed in claim 1, wherein, the drive mechanism is provided with a battery set.

3. An automated induction toilet bowl seat lift system as claimed in claim 1 wherein, both of the drive mechanism and the circuit board module are mounted in a housing, and both sides of the housing being provided with a hole to be pivoted to two shafts provided on both sides of the seat.

4. An automated induction toilet bowl seat lift system as claimed in claim 3 wherein, those shafts provided on both sides of the seat with one shaft being of fixed type having at its one end provided with a passive gear to be engaged with the transmission gear from the drive mechanism, and another shaft movably pivoted on the other side related to a hollow tube to allow penetration of two conductors from the circuit board module and respectively connected to the front and the rear detectors.

5. An automated induction toilet bowl seat lift system as claimed in claim 3, wherein, the housing being locked to a strip locking board and a slot is provided in the locking board.

6. An automated induction toilet bowl seat lift system as claimed in claim 3, wherein, the housing having at a selected side is provided with a switch, a power indicator and a power cable.

7. An automated induction toilet bowl seat lift system as claimed in claim 3, wherein, an ozone de-odorizing device is mounted at a selected position in the housing.

* * * * *